US006162991A

United States Patent [19]

Tayama et al.

[11] Patent Number: 6,162,991

[45] Date of Patent: Dec. 19, 2000

[54] METHOD OF ATTACHING AN ELECTRONIC DEVICE TO A COAXIAL CABLE AND AN ELECTRONIC DEVICE TO BE ATTACHED THERETO

[75] Inventors: Hirofumi Tayama; Tsuneo Hayashi; Yoshiyuki Hata; Tomokatsu Tokiwa, all of Osaka, Japan

[73] Assignee: Kansai Tech Corporation, Osaka, Japan

[21] Appl. No.: 09/089,357

[22] Filed: Jun. 3, 1998

[30] Foreign Application Priority Data

Aug. 8, 1997 [JP] Japan ..... 9-227347

[51] Int. Cl.[7] ..... H01B 3/00

[52] U.S. Cl. ..... 174/71 C; 333/123; 439/394; 439/578

[58] Field of Search ..... 174/72 C, 71 C, 174/71 R, 91, 92; 333/24 R, 124, 123, 136; 439/394, 578, 582, 480, 481, 577, 894, 916

[56] References Cited

U.S. PATENT DOCUMENTS 2,891,222 6/1959 Freen ..... 333/8
4,588,249 5/1986 Blichasz et al. ..... 339/97
5,167,525 12/1992 Wang ..... 439/394
5,689,218 11/1997 Stein et al. ..... 333/125
5,909,154 6/1999 Brown et al. ..... 333/100

*Primary Examiner*—Dean A. Reichard
*Assistant Examiner*—Charlie Nguyen
*Attorney, Agent, or Firm*—Oblon, Spivak, McClelland, Maier & Neustadt, P.C.

[57] ABSTRACT

An electronic device is provided which is configured for attachment to a coaxial cable having a central conductor and an outer conductor. The electronic circuit includes connection conductors that each have a central conductor connection end that is configured to have a portion for engaging and penetrating into the central conductor and to have a further portion serving to impede the connection conductors from becoming withdrawn from the coaxial cable. The configuration of the ends of the connection conductors can be that of an arrowhead. An enclosure is provided around the electronic circuit and the portion of the coaxial cable to which the electronic circuit will be coupled by the connection conductors. In addition, the central conductor are made discontinuous between the points at which the connection conductors engage into the central conductor.

2 Claims, 5 Drawing Sheets

METHOD OF ATTACHING AN ELECTRONIC DEVICE TO A COAXIAL CABLE AND AN ELECTRONIC DEVICE TO BE ATTACHED THERETO

BACKGROUND OF THE INVENTION

1. Field of the Invention

The present invention relates to a method of attaching an electronic device such as a distributor or a signal amplifier to a coaxial cable used for cable communications or cable broadcasting such as CATVs (community antenna televisions), and to an electronic device suitable for being connected to a coaxial cable by the method.

2. Description of the Prior Art

Conventional cable broadcasting has been utilized for providing telecasting or textual information to people in areas where radio waves can not be received or to subscribers such as hotels. In addition to this utilization just for providing broadcasting such as CATVs, it is expected to utilize cable transmission as an integral information system capable of duplex transmission with multiple functions of, for example, telephone, facsimile, internet, CATV, ticket reservations and the like.

Electronic devices such as modems, adaptors for communication equipment and the like are adapted to be supplied with power through associated coaxial cables transmitting video or audio signals therethrough so that information systems can remain available even when commercial power failure occurs. It is now possible that even telephone systems are kept available during the failure of commercial power.

FIG. 1 shows a coaxial cable 2 attached with electronic devices 1 such as a signal amplifier and a distributor. Before the commencement of cable broadcasting service or cable communication service, coaxial cables are disposed in place and then attached with a distributor having an output terminal to be connected to a lead-in wire of a user house. If video or audio information signals do not reach a predetermined level, problems of unclear images, inaccurate signal transmission and the like occur. Accordingly, signal amplifiers are attached to the coaxial cable at predetermined intervals so as to increase the signal level to above the predetermined level.

Initially, an area consisting of, for example, one hundred houses is provided with such coaxial cable equipment capable of servicing for sixty houses, because it is rare that all the families in such area wish to use for example cable broadcasting services from the beginning.

Accordingly, when the demand for such services increases, electronic devices such as signal amplifiers or distributors need to be added as required.

To add such electronic devices, the coaxial cable is once cut off at a portion to which any required electronic device is to be attached. Subsequently, a connector is attached to each of the cut ends of the cable and then connected to the electronic device.

However, such attaching work causes breakage of power and signal supply to houses located downstream of the cut portion of the cable, thereby causing users in the downstream houses to become incapable of making use of any service such as cable broadcasting. Further, it inconveniently causes such users to become incapable of using telephones where power is supplied to their associated modems or like devices through the coaxial cable.

Further, an increase in part count due to addition of connectors or a like devices causes reflection of signals to occur more likely at connecting portions, resulting in degradation of electric characteristics such as standing wave ratio and the like.

Moreover, such attaching work usually includes many processes such as cutting the coaxial cable and attaching connectors thereto at high elevations and hence requires a longer time. For the purpose of avoiding accidents of falling from the workplace, it is desirable that such processes at high elevations be completed in a shorter time.

It is therefore an object of the present invention to provide a method of attaching an electronic device such as a signal amplifier or a distributor to a coaxial cable which eliminates the necessity of cutting the coaxial cable in attaching such electronic devices to the coaxial cable and which enables such attaching work in a shorter time without degrading the mechanical strength and electric characteristics of the coaxial cable.

It is another object of the present invention to provide an electronic device which is capable of being attached to a coaxial cable by the method.

SUMMARY OF THE INVENTION

According to a first aspect of the present invention, there is provided a method of attaching an electronic device to a coaxial cable having a central conductor and an outer conductor, comprising the steps of: forming two connection holes in the coaxial cable so as to extend through the outer conductor but not to reach the central conductor; inserting two connection conductors each having one end in the form of an arrowhead and an opposite end connected to an electronic circuit of the electronic device into the two connection holes, respectively, until the connection conductors are stuck into the central conductor thereby electrically connecting the electronic circuit to the central conductor of the coaxial cable; forming a breaking hole having a larger diameter than the central conductor in the coaxial cable between the two connection holes to cut off the central conductor; and attaching an enclosure to the coaxial cable so as to enclose the electronic circuit and a portion of the coaxial cable fitted with the connection conductors.

With this method, the central conductor and the electronic circuit can be connected to each other by inserting the connection conductors connected to the electronic circuit into the connection holes. The portion of the central conductor between the two connection holes which becomes no longer necessary is cut off by forming the breaking hole. The electronic circuit and the portion of the coaxial cable to which the electronic circuit is connected are covered by the enclosure. Thus, the electronic device can be attached to the coaxial cable without cutting off the coaxial cable and, hence, services through the coaxial cable can continue even during the attaching work.

According to a second aspect of the present invention, there is provided a method of attaching an electronic device to a coaxial cable having a central conductor and an outer conductor, comprising the steps of: forming two connection holes in the coaxial cable so as to extend through the outer conductor but not to reach the central conductor; inserting two connection conductors each having one end in the form of an arrowhead and an opposite end connected to an electronic circuit of the electronic device into the two connection holes, respectively, until the connection conductors are stuck into the central conductor thereby electrically connecting the electronic circuit to the central conductor of the coaxial cable; forming two breaking holes each having a larger diameter than the central conductor in the coaxial cable between the two connection holes to cut off the central conductor at two portions; short-circuiting a portion of the central conductor existing between the two breaking holes with the outer conductor; and attaching an enclosure to the coaxial cable so as to enclose the electronic circuit and a portion of the coaxial cable fitted with the connection conductors.

With this method, in addition to the same advantageous effect as with the first method, the portion of the central conductor which is located between the two breaking holes and no longer used for transmitting signals is short-circuited with the outer conductor. Thus, the portion of the central conductor and the outer conductor assume the same potential, thereby minimizing undesirable influence from the unnecessary portion of the central conductor on the surroundings.

According to a third aspect of the present invention, there is provided an electronic device to be attached to a coaxial cable having a central conductor and an outer conductor, comprising: an electronic circuit; connection conductors each having one end in the form of an arrowhead capable of being stuck into the central conductor and an opposite end connected to the electronic circuit; and an enclosure capable of enclosing the electronic circuit and a portion of the coaxial cable to be fitted with the connection conductors.

With this electronic device, which is suitable for being attached to a coaxial cable by the foregoing methods of the present invention, the electronic circuit and the central conductor can be electrically connected to each other by sticking the arrowhead-shaped end of each connection conductor into the central conductor. Further, since the electronic circuit and the connecting portion of the coaxial cable can be covered by the enclosure, the electronic circuit and the portion of the coaxial cable fitted with the connection conductors can be shielded and protected.

The foregoing and other objects, features and attendant advantages will become readily apparent from the reading of the following detailed description of the invention in conjunction with the attached drawings, in which:

DETAILED DESCRIPTION OF THE PREFERRED EMBODIMENTS

The present invention will now be described in detail with reference to the accompanying drawings.

Figure 1:
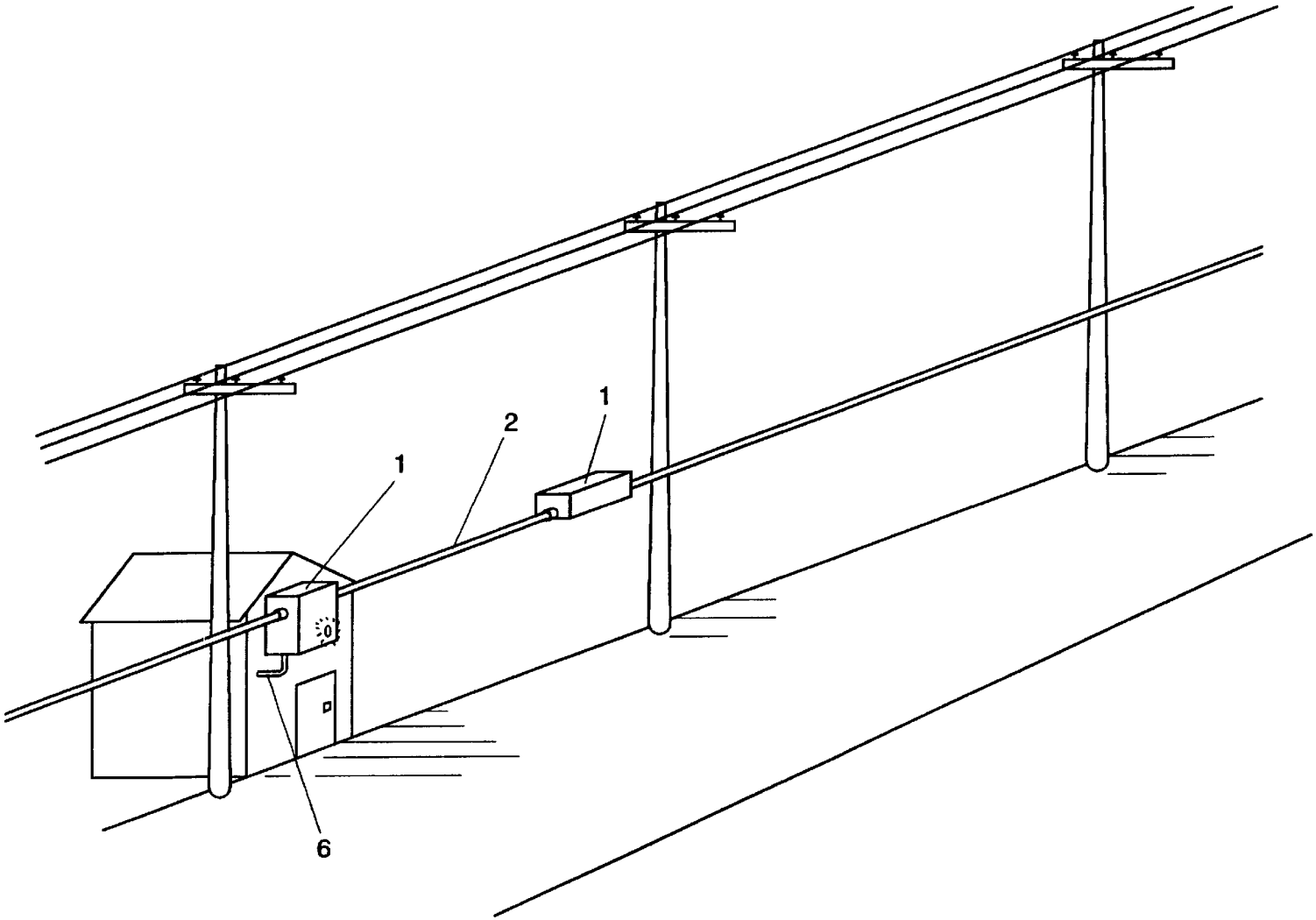
FIG. 1 shows a coaxial cable to which electronic devices are attached.
Figure 2B:
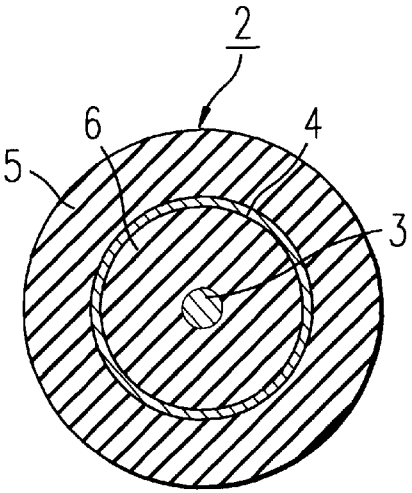
FIG. 2*b* is a cross sectional view illustrating a coaxial cable.
Figure 2A:
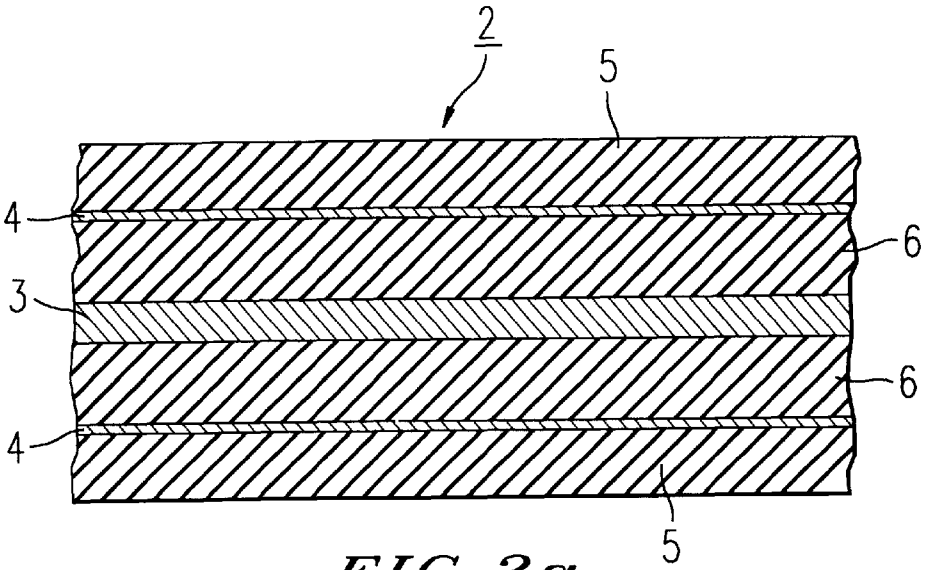
FIG. 2*a* is an axial sectional view illustrating a coaxial cable.

FIGS. 2*a* and 2*b* show a typical coaxial cable 2. The coaxial cable 2 comprises a central conductor (core wire) 3, an outer conductor 4 comprising an aluminum tube, an intermediate insulating layer 6 formed of expanded polyethylene disposed between the central conductor 3 and the outer conductor 4, and a covering member 5 formed of polyethylene surrounding the outer conductor 4.

Figure 3B:
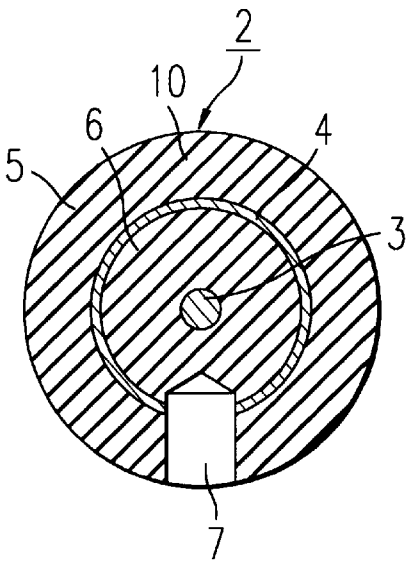
FIG. 3*b* is a cross sectional view corresponding to FIG. 3*a;*
Figure 3A:
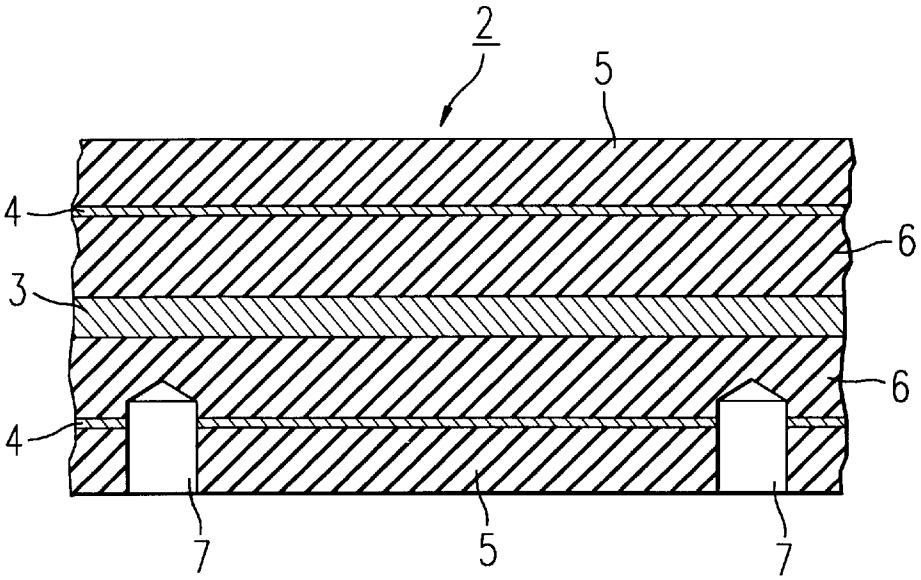
FIG. 3*a* is an axial sectional view illustrating a step of a method according to the present invention.
Figure 4B:
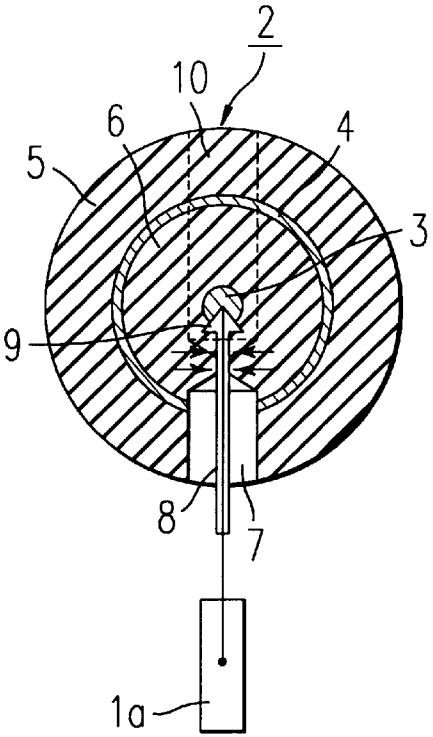
FIG. 4*b* is a cross sectional view corresponding to FIG. 4*a;*
Figure 4A:
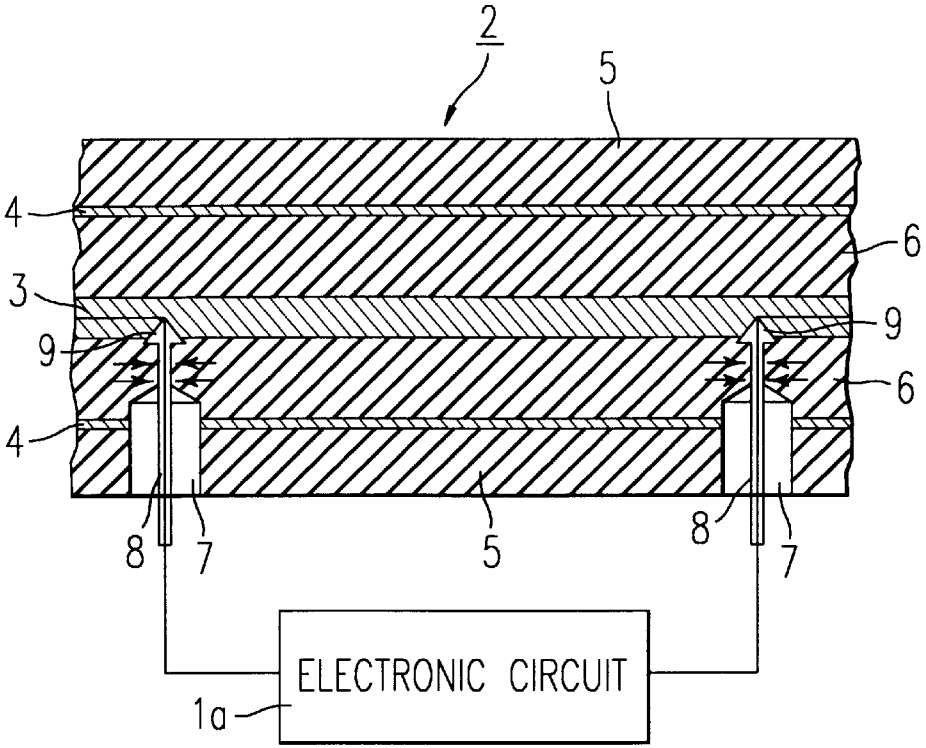
FIG. 4*a* is an axial sectional view illustrating a step of the method.
Figure 5B:
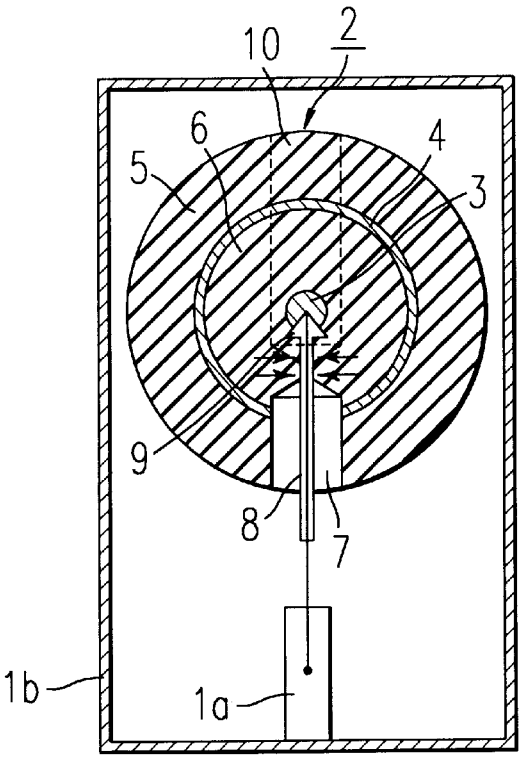
FIG. 5*b* is a cross sectional view corresponding to FIG. 5*a.*
Figure 5A:
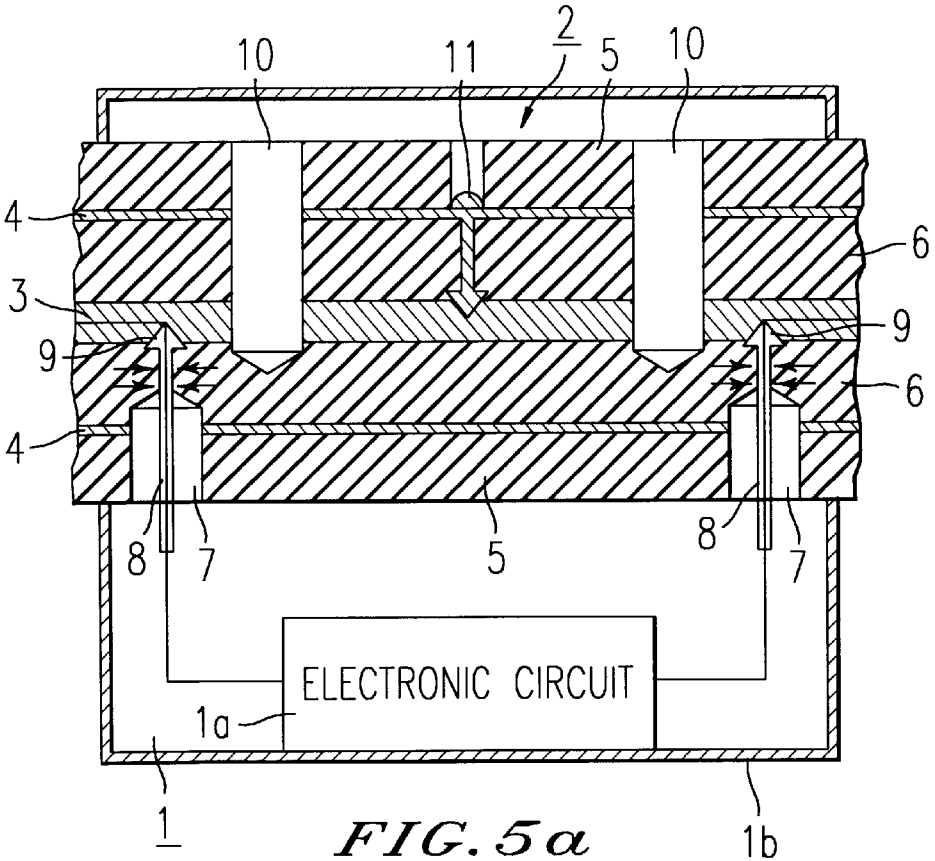
FIG. 5*a* is an axial sectional view illustrating a step of the method according to the present invention.

According to an example of the present invention, an electronic device such as a signal amplifier or a distributor is attached to the coaxial cable by following the steps illustrated in FIGS. 3 to 5 in this order.

Firstly, as shown in FIG. 3, two connection holes 7 are formed in the coaxial cable 2 by the use of a drill or the like so that each hole extends through the cover member 5 and the outer conductor 4. The leading end of each connection hole 7 is located in the intermediate insulating layer 6 so as not to reach the central conductor 3. The distance between the two connection holes 7 is determined depending on the size of the electronic device to be attached.

Subsequently, as shown in FIG. 4, two connection conductors 8 each connected to a terminal of electronic circuit 1*a* of the electronic device 1 are connected to the central conductor 3. Since tip end portion 9 of each connection conductor 8 is in the form of an arrowhead, it extends through the soft intermediate insulating layer 6 and contacts the central conductor 3 when each connection conductor 8 is inserted into respective connection hole 7. As each connection conductor 8 is further inserted into respective connection hole 7, the tip end portion 9 is stuck into the central conductor 3, and thus, electric connection between the central conductor 3 and the electronic circuit la is assuredly achieved.

In this way, one of the connection conductors 8 inserted in one connection hole 7 will serve to transmit signals from the central conductor 3 to the electronic circuit 1*a*, while the other connection conductor 8 inserted into the other connection hole 7 will serve to transmit signals from the electronic circuit la to the central conductor 3.

Since the end portion 9 of the connection conductor 8 is shaped like an arrowhead, the "barb" portion of the end portion engages the intermediate insulating layer 6 if force to pull out the connection conductor 8 is exerted thereon. Accordingly, the connection conductor 8 once stuck into the central conductor (3) does not fall off easily.

At this stage a branch is formed flowing central conductor 3→connection conductor 8→electronic circuit 1*a*→connection conductor 8→central conductor 3 and, therefore, the portion of the central conductor 3 between the two connection holes 7 becomes unnecessary. Accordingly, this portion of the central conductor 3 between the two connection holes 7 is cut off for breaking the passage of electric current through the portion.

Specifically, two breaking holes 10 extending crosswise through the central conductor 3 are formed between the two connection holes 7 by the use of a drill having a larger diameter than the central conductor 3. Since each of the two breaking holes 10 has a diameter larger than the central conductor 3, the central conductor 3 is cut off by the breaking holes 10 and, hence, electric current through the portion of the central conductor 3 between the two breaking holes 10 is interrupted. The breaking holes (10) may be of any depth which is sufficient to cut off the central conductor 3. Preferably, the breaking holes (10) have a depth which does not reach the outer conductor 4 on opposite side so that the coaxial cable has a sufficient strength.

In this embodiment, in order to avoid undesirable influence from the cut off portion of the central conductor 3 located between the two breaking holes 10, this portion is short-circuited with the outer conductor 4 by the use of a grounding member 11. The grounding member 11 is in the form of a pin and disposed so as to be stuck into the cable between the two breaking holes 10.

Where the impedance of the unnecessary portion of the central conductor 3 between the two connection holes 7 is so low that little undesirable influence on the surroundings occur, the unnecessary portion of the central conductor 3 may be merely cut off by providing at least one breaking hole 10 therethrough without short-circuiting.

After the electronic circuit 1*a* is adjusted, the electronic circuit 1*a* and the portions of the coaxial cable 2 to which the connection conductors 8 are attached including the connection holes 7, connection conductors 8 and breaking holes 10 are enclosed with an enclosure 1*b* thereby preventing entry of rainwater, noise and the like into such portions.

Since the enclosure 1*b* supports the weight of the electronic circuit 1*a*, the end portion 9 of each connection conductor 8 is less likely to come off from the central conductor 3 due to the weight of the electronic circuit 1*a*.

The method according to the present invention does not involve the step of cutting off the coaxial cable 2, the construction work to add electronic devices to coaxial cable equipment can be performed with services through the cable 2 such as textual broadcasting being kept continued. As a result, such construction work does not cause any inconvenience such as interruption of services to users.

Further, the strength of the coaxial cable 2 can be maintained because the tubular outer conductor 4 which contributes to the mechanical strength of the coaxial cable 2 is removed only from the portions in which the connection holes 7 and the breaking holes 10 are provided.

Furthermore, since the method does not require troublesome operations such as cutting off the coaxial cable 2 and attaching connectors to the cable, working at high elevations can be completed easily in a shorter time and, hence, the safety of the construction work can be improved. Moreover, there is no increase in a part count due to additional parts such as connectors, electric characteristics such as standing wave ratio of the coaxial cable equipment are less likely to be degraded.

As has been described, the present invention provides a method of attaching an electronic device such as a signal amplifier or a distributor to a coaxial cable which eliminates the necessity of cutting off the coaxial cable and which enables the attaching operation to be completed in a shorter time without degrading the mechanical strength and electric characteristics of the coaxial cable.

The present invention further provides an electronic device capable of being attached to a coaxial cable by the method.

While only a certain presently preferred embodiment of the invention has been described in detail, as will be apparent with those skilled in the art, certain changes and modifications can be made in embodiment without departing from the spirit and scope of the invention as defined in following claims.

What is claimed is:

1. An electronic device configured to be attached to a coaxial cable having a central conductor and an outer conductor, comprising:

an electronic circuit;

connection conductors each having one end configured to be connected to spaced apart portions of the central conductor by being stuck into the central conductor, said one end including at least a portion further configured to impede the one end from being withdrawn from the coaxial cable and an opposite end connected to the electronic circuit;

two breaking holes each having a larger diameter than the central conductor in the coaxial cable between two connection holes in said coaxial cable to cut off the central conductor at two portions; and an enclosure configured to enclose the electronic circuit and a portion of the coaxial cable to be fitted with the connection conductors.

2. The electronic device of claim 1, wherein each one end of said connection conductors are in the form of an arrowhead with the point of the arrowhead serving to stick the connection conductors into the central conductor and with the base of the arrowhead serving to impede the one end from being withdrawn from the coaxial cable.

* * * * *